US009623672B2

(12) United States Patent
Aizawa

(10) Patent No.: US 9,623,672 B2
(45) Date of Patent: Apr. 18, 2017

(54) THERMAL PRINTER WITH PLATEN LOCK MECHANISM AND HEAD URGING MEMBER

(71) Applicant: Seiko Instruments Inc., Chiba-shi, Chiba (JP)

(72) Inventor: Kazuyuki Aizawa, Chiba (JP)

(73) Assignee: SEIKO INSTRUMENTS INC., Chiba (JP)

( * ) Notice: Subject to any disclaimer, the term of this patent is extended or adjusted under 35 U.S.C. 154(b) by 0 days.

(21) Appl. No.: 14/969,599

(22) Filed: Dec. 15, 2015

(65) Prior Publication Data

US 2016/0185135 A1 Jun. 30, 2016

(30) Foreign Application Priority Data

Dec. 24, 2014 (JP) ..... 2014-260734

(51) Int. Cl.
*B41J 2/32* (2006.01)
*B41J 25/34* (2006.01)
*B41J 25/312* (2006.01)

(52) U.S. Cl.
CPC ..... *B41J 2/32* (2013.01); *B41J 25/312* (2013.01); *B41J 25/34* (2013.01); *B41J 2202/31* (2013.01)

(58) Field of Classification Search
CPC ..... B41J 2/325; B41J 11/04; B41J 2/32
See application file for complete search history.

(56) References Cited

U.S. PATENT DOCUMENTS

2004/0119808 A1 6/2004 Mori
2007/0030331 A1* 2/2007 Sutherland ..... B41J 2/32 347/222

(Continued)

FOREIGN PATENT DOCUMENTS

EP 1 323 535 A2 7/2003
EP 1 602 502 A1 12/2005

(Continued)

OTHER PUBLICATIONS

Extended Search Report in corresponding European Application No. 15201348.8, dated Jun. 13, 2016, 9 pages.

*Primary Examiner* — Daniel J Colilla
(74) *Attorney, Agent, or Firm* — Brinks Gilson & Lione

(57) ABSTRACT

A printing unit comprises: a main body frame; a platen roller removably mounted to the main body frame; a lock mechanism pivotably supported by the main body frame between a lock position at which the platen roller is rotatably held by the main body frame and an unlock position at which the platen roller is removable from the main body frame; a thermal head to be brought into pressure contact with an outer circumferential surface of the platen roller; a head support body configured to support the thermal head, the head support body being pivotably supported by the main body frame in such directions that the thermal head and the platen roller are brought closer to and away from each other; an urging member interposed between the lock mechanism and the head support body, the urging member being configured to urge the lock mechanism toward the lock position and urge the head support body in such a direction that the thermal head is brought closer to the platen roller; and a head pressing member configured to press the head support body in such a direction that the thermal head is brought closer to the platen roller.

5 Claims, 9 Drawing Sheets

(56) References Cited

U.S. PATENT DOCUMENTS

| | | | | |
|---|---|---|---|---|
| 2008/0068437 | A1* | 3/2008 | Hirai | B41J 15/042 347/220 |
| 2008/0068438 | A1* | 3/2008 | Hirai | B41J 2/325 347/220 |
| 2008/0178753 | A1* | 7/2008 | Takahashi | B41J 2/32 101/41 |
| 2011/0072995 | A1* | 3/2011 | Kamata | B41J 11/04 101/480 |

FOREIGN PATENT DOCUMENTS

| | | | |
|---|---|---|---|
| EP | 1 950 042 | A1 | 7/2008 |
| EP | 1 990 531 | A1 | 11/2008 |
| EP | 2 765 005 | A1 | 8/2014 |
| JP | 2003-200624 | A | 7/2003 |

* cited by examiner

THERMAL PRINTER WITH PLATEN LOCK MECHANISM AND HEAD URGING MEMBER

RELATED APPLICATIONS

This application claims priority under 35 U.S.C. §119 to Japanese Patent Application No. 2014-260734 filed on Dec. 24, 2014, the entire content of which is hereby incorporated by reference.

FIELD OF THE INVENTION

The present invention relates to a printing unit and a thermal printer.

DESCRIPTION OF THE RELATED ART

Hitherto, a thermal printer has been known as a printer configured to print on a recording sheet (heat-sensitive paper). The thermal printer includes a printing unit that can be reduced in size and weight, and has a simple configuration without using toner or ink. Therefore, the thermal printer is employed for cash registers or mobile terminal devices to be widely used to print various labels, receipts, and tickets.

The printing unit mainly includes a platen roller removably mounted to a main body frame, a lock mechanism pivotably supported by the main body frame, which is configured to hold the platen roller so that the platen roller is rotatably held by the main body frame, a thermal head with which an outer circumferential surface of the platen roller is brought into pressure contact, and a head support body configured to support the thermal head.

Incidentally, in the printing unit, for the purpose of stabilizing print quality, it is necessary that the thermal head and the platen roller be brought into pressure contact with each other with a desired contact pressure. In this case, as the width of the recording sheet becomes larger, the contact pressure (head pressurizing force) is required to be larger.

As a mechanism configured to hold a platen roller of this kind, hitherto, there is known a configuration in which an urging member configured to urge the lock mechanism toward a lock position at which the platen roller is rotatably held and configured to urge the head support body toward a direction in which the thermal head comes closer to the platen roller is interposed between the lock mechanism and the head support body.

It is said that, according to this configuration, the platen roller can be held by the main body frame at a desired position, and the thermal head can be pressed against the platen roller with a desired contact pressure. In particular, the urging member has both the function to urge the lock mechanism to hold the platen roller (platen holding) and the function to pressurize the thermal head (head pressurization), and thus, compared with a case in which the urging member is separately arranged for each of the functions, the number of components is reduced.

However, in the related art described above, both the platen holding and the head pressurization are carried out by the same urging member, and thus, there is a problem in that desired urging force for each of the functions cannot be applied. Specifically, when the platen roller is in a mounted state of being held by the main body frame, urging force to hold the platen and to pressurize the head acts on the urging member. In this state, when the platen roller is removed from the main body frame, movement of the lock mechanism toward an unlock position at which the platen roller is removable from the main body frame further compresses the urging member. This increases the urging force of the urging member, which requires a significantly large force in operation of mounting/removing the platen roller, and operability may be lowered. On the other hand, when the urging force of the urging member is reduced for the purpose of securing operability, pressurization of the head in the mounted state becomes insufficient, and the desired contact pressure described above may not be secured.

In view of the above, a printing unit and a thermal printer that can inhibit increase in the number of components and can still secure print quality and operability are desired in the field of art.

SUMMARY OF THE INVENTION

According to one embodiment of the present invention, there is provided a printing unit, including: a main body frame; a platen roller removably mounted to the main body frame; a lock mechanism pivotably supported by the main body frame between a lock position at which the platen roller is rotatably held by the main body frame and an unlock position at which the platen roller is removable from the main body frame; a thermal head to be brought into pressure contact with an outer circumferential surface of the platen roller; a head support body configured to support the thermal head, the head support body being pivotably supported by the main body frame in such directions that the thermal head and the platen roller are brought closer to and away from each other; an urging member interposed between the lock mechanism and the head support body, the urging member being configured to urge the lock mechanism toward the lock position and urge the head support body in such a direction that the thermal head is brought closer to the platen roller; and a head pressing member configured to press the head support body in such a direction that the thermal head is brought closer to the platen roller.

According to this configuration, through urging of the lock mechanism toward the lock position by the urging force of the urging member, predetermined platen holding force acts on the platen roller. On the other hand, through pressing of the head support body by the urging force of the urging member and the pressing force of the head pressing member in such a direction that the thermal head is brought closer to the platen roller, predetermined head pressurizing force acts between the platen roller and the thermal head. This enables platen holding force to be reduced compared with a case in which both platen holding and head pressurization are carried out by the same urging member, and still, desired head pressurizing force to be secured. As a result, operability of the lock mechanism may be improved and print quality may be secured. Further, the desired head pressurizing force is secured by both the urging member and the head pressing member, and thus, compared with a case in which the platen holding and the head pressurization are separately carried out by different urging members, pressing members, or the like, the number of components may be reduced and costs may be reduced.

In addition, the head pressing member presses only the head support body, and thus, by changing the number, the kind, and the like of the head pressing members, only the head pressurizing force may be independently adjusted under a state in which the platen holding force is maintained, and desired head pressurizing force depending on a sheet width may be secured. Further, as described above, the platen holding force may be reduced, and thus, the lock mechanism may be thinned and the degree of design freedom may be improved.

In the printing unit according to the one embodiment of the present invention, the head pressing member is a spring configured to urge the head support body in such a direction that the thermal head is brought closer to the platen roller. According to this configuration, the head pressing member is formed of a spring, and thus, simplification and lower costs are attained, and still, the desired head pressurizing force may be secured.

In the printing unit according to the one embodiment of the present invention, the lock mechanism individually holds both end portions of the platen roller in an axial direction of the platen roller, and the urging member is arranged outside the head pressing member in the axial direction of the platen roller. According to this configuration, the urging member is arranged outside the head pressing member in the axial direction of the platen roller, and thus, the urging member and the lock mechanism may be brought closer to each other, and operational stability of the lock mechanism may be secured.

In the printing unit according to the one embodiment of the present invention, the head pressing member is interposed between the main body frame and the head support body. According to this configuration, the head pressing member is interposed between the main body frame and the head support body, and thus, the printing unit may be assembled to a housing with the head pressing member being assembled thereto. This may improve ease of assembly when the printing unit is assembled to the housing compared with a configuration in which the head pressing member is interposed between the housing and the head support body.

A printer according to one embodiment of the present invention includes the printing unit described above. According to this configuration, the printer includes the printing unit, and thus, a thermal printer excellent in print quality and operability may be provided.

As described above, according to the printing unit and the printer of the one embodiment of the present invention, excellent print quality and operability may be provided, while the number of components is prevented from increasing.

DETAILED DESCRIPTION OF THE PREFERRED EMBODIMENTS

An embodiment of the present invention is now described referring to the accompanying drawings.

Figure 1:
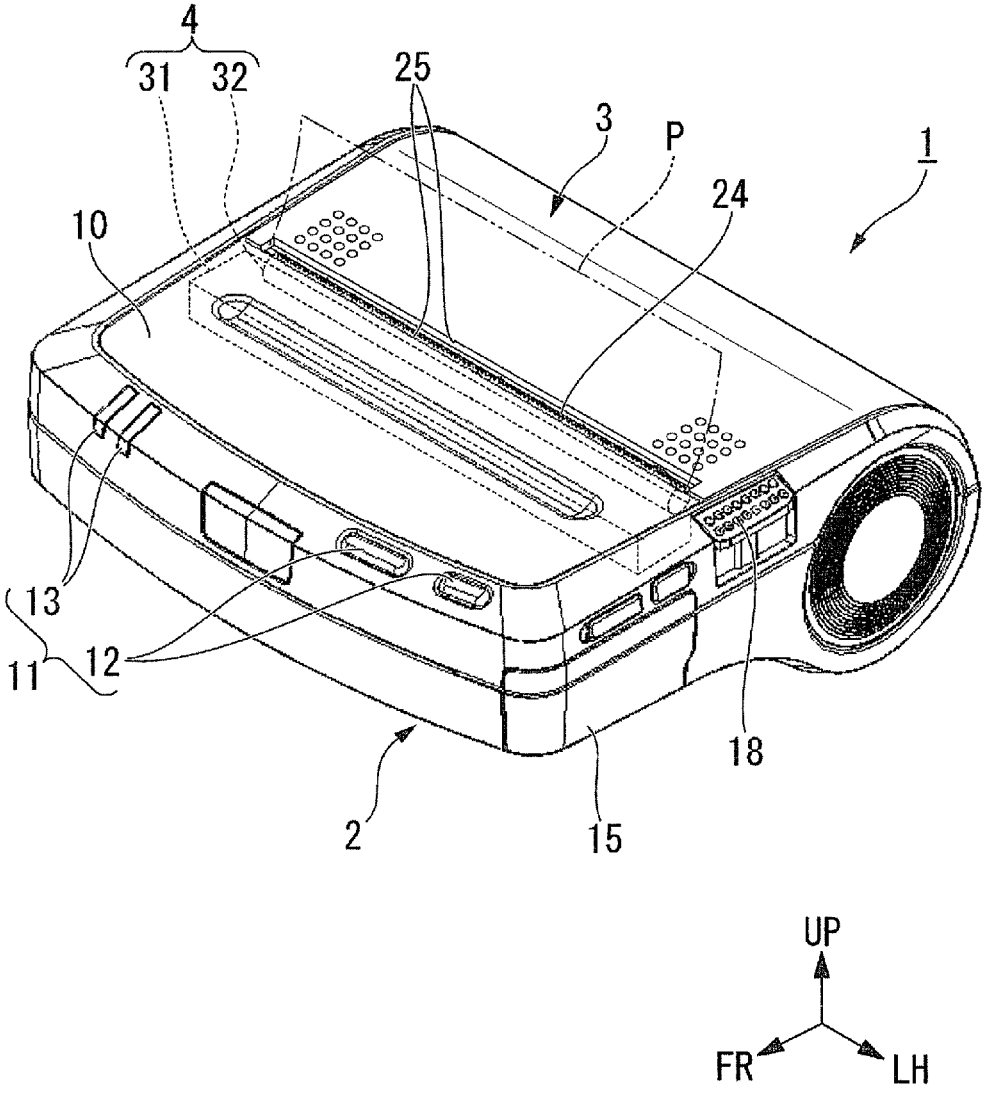
FIG. 1 is a perspective view for illustrating a state in which a paper cover in a thermal printer is located at a closed position.
Figure 2:
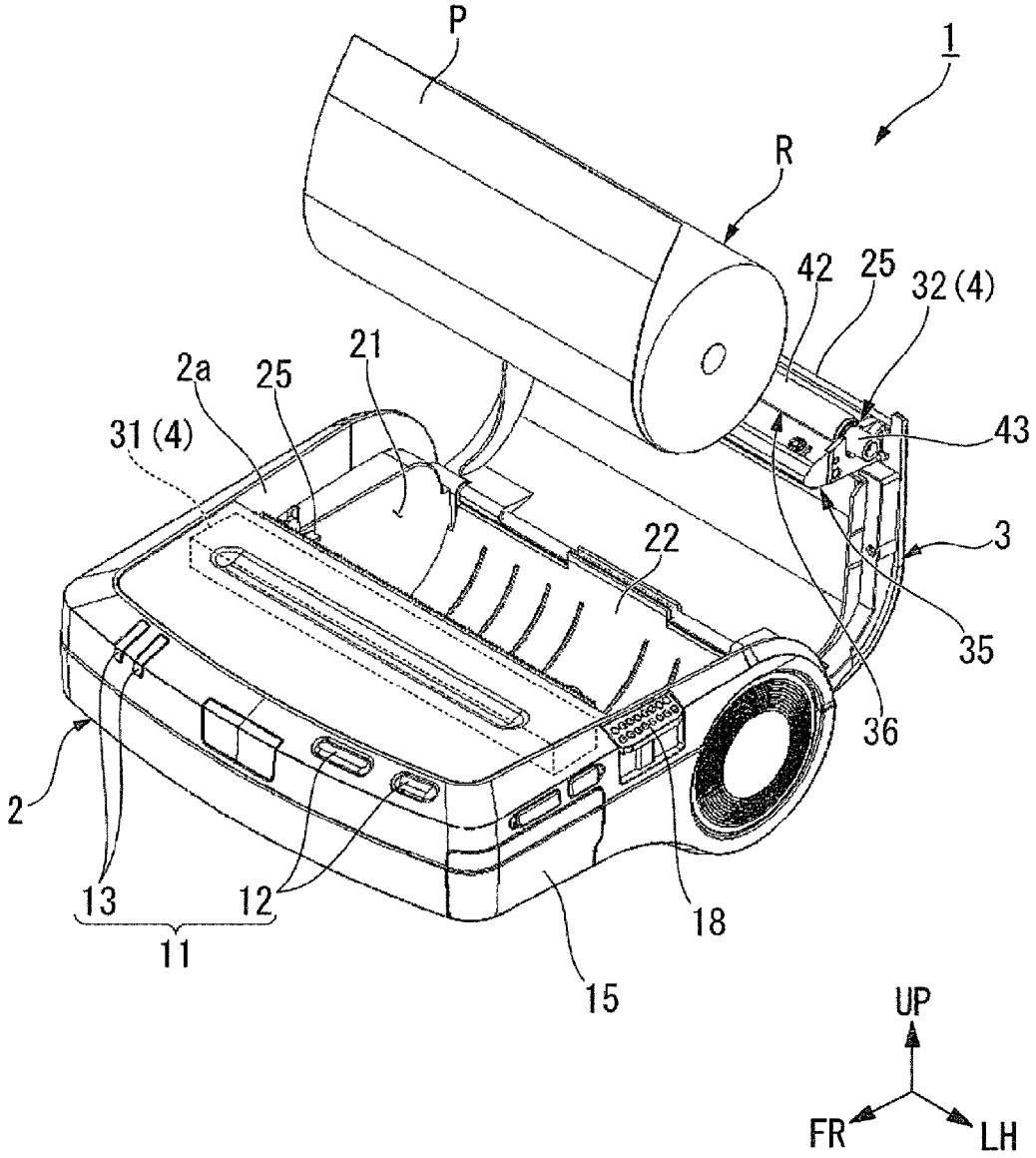
FIG. 2 is a perspective view for illustrating a state in which the paper cover in the thermal printer is located at an opened position.

FIG. 1 is a perspective view for illustrating a state in which a paper cover 3 in a thermal printer 1 is located at a closed position. FIG. 2 is a perspective view of the thermal printer 1 in which the paper cover 3 is located at an opened position. Note that, in the following description, for the sake of easy understanding of the present invention, the illustrations are simplified through partial omission of components as appropriate, simplification of a shape, and changing of a scale. Further, in the figures, FR, LH, and UP denote frontward, leftward, and upward, respectively.

As illustrated in FIG. 1 and FIG. 2, the thermal printer 1 mainly includes a casing 2 having an opening 2*a* (see FIG. 2), the paper cover 3 pivotably supported by the casing 2, which is configured to expose and close the opening 2*a* in the casing 2, and a printing unit 4 mounted on the casing 2 and the paper cover 3.

The casing 2 is formed of a resin material such as polycarbonate or a metal material, and is formed in the shape of a box having a front portion in the shape of a rectangular parallelepiped having an upper wall 10 and a rear portion having the opening 2*a* that opens upward. An operating portion 11 for instructions for various kinds of operation of the thermal printer 1 is arranged on the upper wall 10 of the casing 2. Switches 12 for various kinds of functions such as a power switch and a feed switch are arranged in the operating portion 11, and in addition, various kinds of lamps 13 such as a power lamp for information of ON/OFF of the power switch and an error lamp configured to indicate an error in the thermal printer 1 are arranged adjacent to the switches 12 for the functions. Further, an open button 18 of the paper cover 3 is arranged between the upper wall 10 and a side wall 15 of the casing 2.

A roll sheet receiving portion 21 configured to receive a roll sheet R through the opening 2*a* is defined in the rear portion of the casing 2. The roll sheet receiving portion 21 includes a guide plate 22 configured to hold the roll sheet R, and the roll sheet R is held between the guide plate 22 and an inner surface of the paper cover 3 so as to cover the roll sheet R. The guide plate 22 is in the shape of an arc in section seen in a horizontal direction, and holds the roll sheet R under a state in which an inner circumferential surface thereof is in contact with an outer circumferential surface of the roll sheet R and guides, to the printing unit 4, a recording sheet P that is drawn out of the roll sheet R. Note that, the recording sheet P used in this embodiment is heat-sensitive paper and is suitably used for printing various kinds of labels, receipts, tickets, and the like. The recording sheet P is wound into a roll to form the roll sheet R having a hole at the center thereof. The printing unit 4 performs printing on a portion of the recording sheet P that is drawn out of the roll sheet R.

The paper cover 3 is formed of a resin material such as polycarbonate. A rear end of the paper cover 3 is pivotably supported on a hinge shaft (not shown) with respect to the casing 2, and a front end of the paper cover 3 is engageable with the casing 2 via a platen unit 32 described later. Through press down of the open button 18 on the casing 2, engagement between the casing 2 and the paper cover 3 is released and the paper cover 3 pivots from the closed position (see FIG. 1) to the open position (see FIG. 2). Further, a clearance between a front edge of the paper cover 3 and a rear edge of the upper wall 10 of the casing 2 when the paper cover 3 is located at the closed position forms a discharge port 24 (see FIG. 1) for discharging the printed recording sheet P therethrough.

A cutting blade 25 configured to cut the recording sheet P discharged through the discharge port 24 is arranged at an opening edge of the discharge port 24. The cutting blade 25 is formed so as to be integral with the rear edge of the upper wall 10 of the casing 2 (a front part of the opening edge) and the front edge of the paper cover 3. Through pulling of the recording sheet P against the cutting blade 25, the recording sheet P is cut.

The printing unit 4 includes a head unit 31 arranged at a rear end portion of the upper wall 10 of the casing 2, and a platen unit 32 arranged at a front end portion of the paper cover 3 to be removably combined with the head unit 31 along with operation of opening and closing the paper cover 3.

Figure 3:
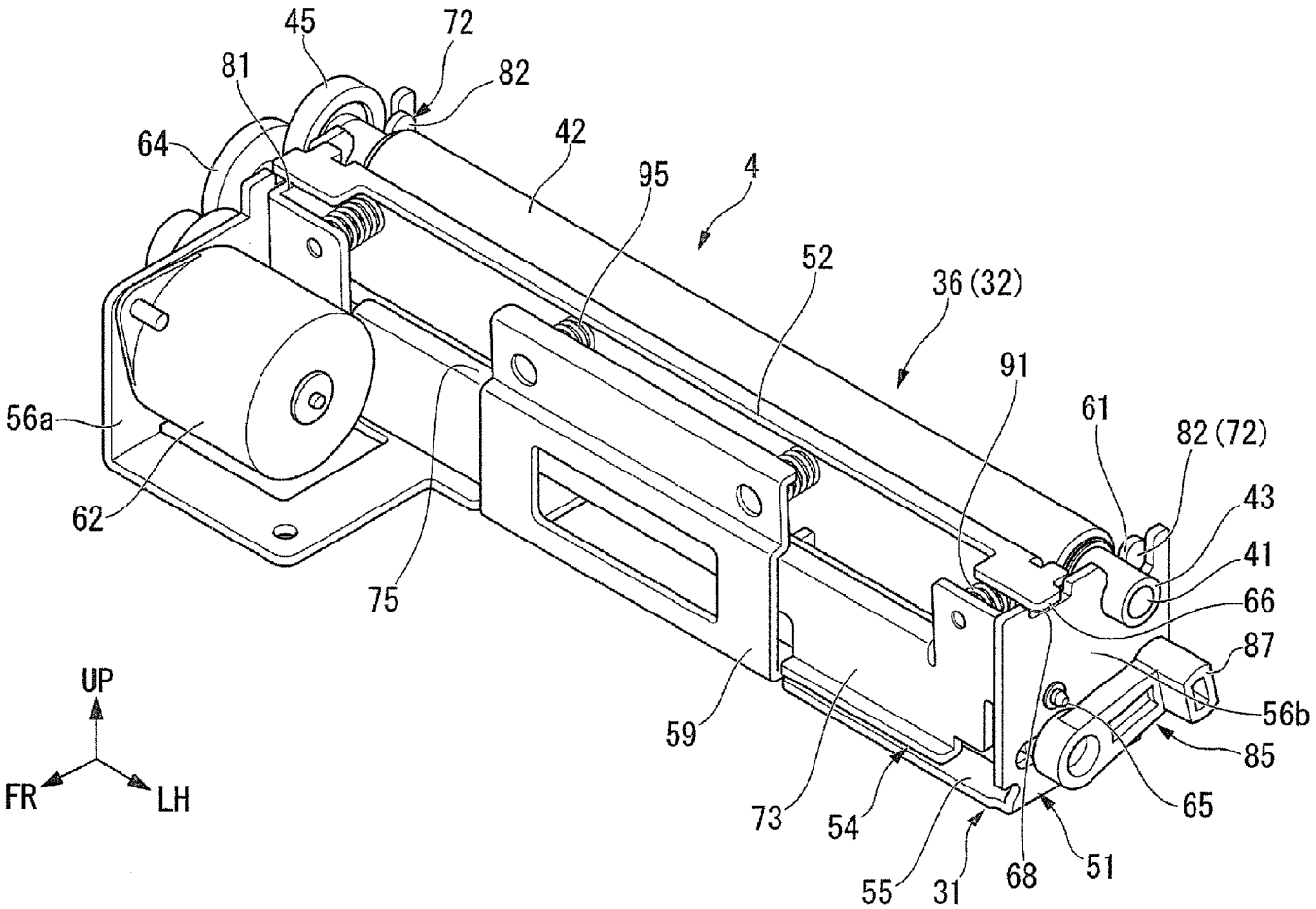
FIG. 3 is a perspective view of a printing unit seen from front.
Figure 4:
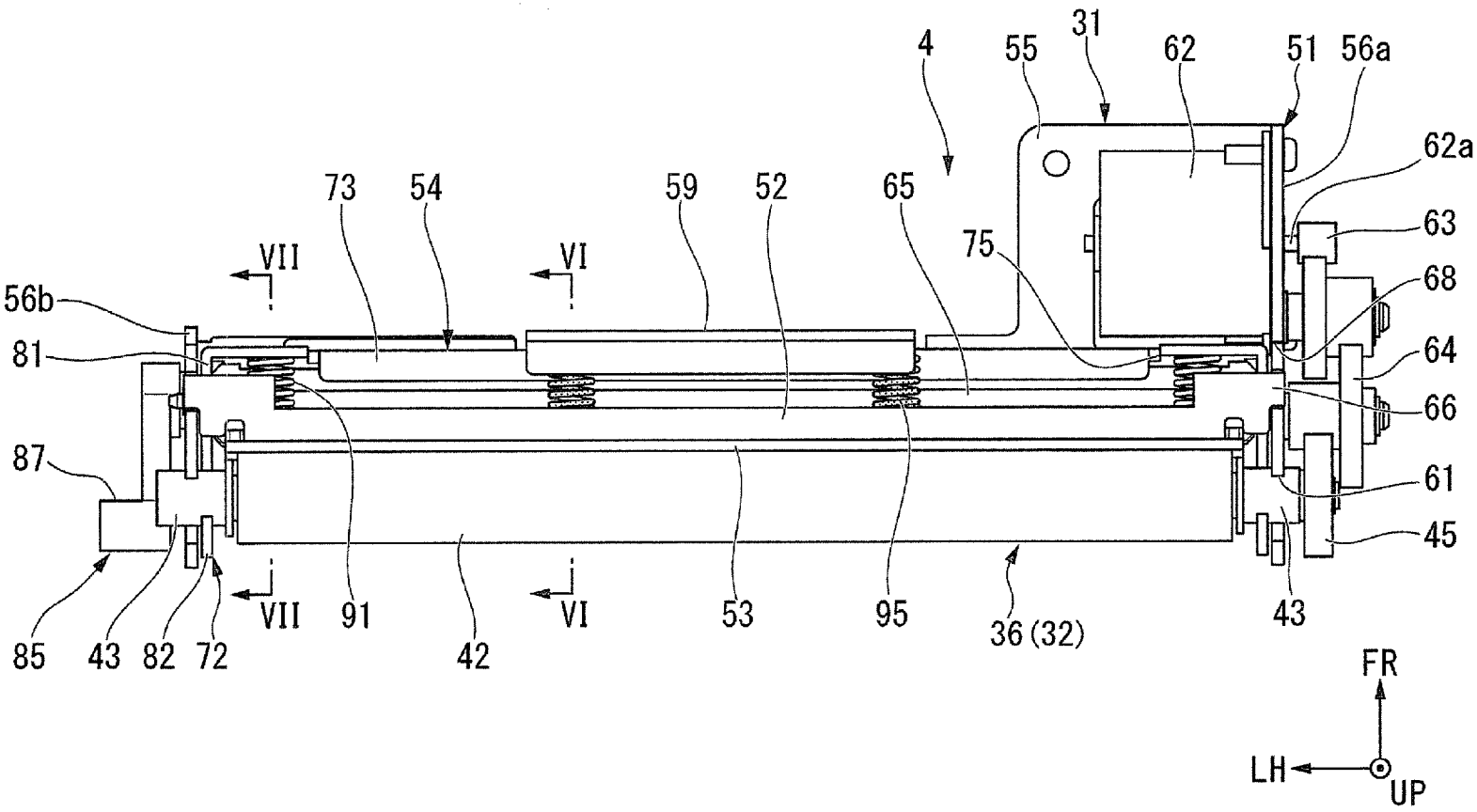
FIG. 4 is a plan view of the printing unit seen from above.

FIG. 3 is a perspective view of the printing unit 4 seen from front, and FIG. 4 is a plan view of the printing unit 4 seen from above. Note that, FIG. 3 and FIG. 4 are illustrations of a mounted state in which the platen unit 32 is mounted to the head unit 31.

As illustrated in FIG. 2, the platen unit 32 includes a platen frame 35 mounted to the paper cover 3 and a platen roller 36 rotatably supported by the platen frame 35.

The platen roller 36 includes a platen shaft 41 extending along the horizontal direction and a roller main body 42 formed of rubber or the like that is externally mounted to the platen shaft 41. A bearing 43 configured to rotatably support the platen shaft 41 is externally mounted to each end portion of the platen shaft 41. Each of the bearings 43 is held by the platen frame 35 (see FIG. 2), and the platen roller 36 is rotatably supported by the platen frame 35 via the bearings 43.

A gear 45 for the platen is mounted to a right end portion of the platen shaft 41. When the platen unit 32 and the head unit 31 are combined with each other, the gear 45 for the platen is engaged with a gear train mechanism 64 to be described later on the head unit 31 side to transfer rotational force to the platen roller 36.

Figure 5:
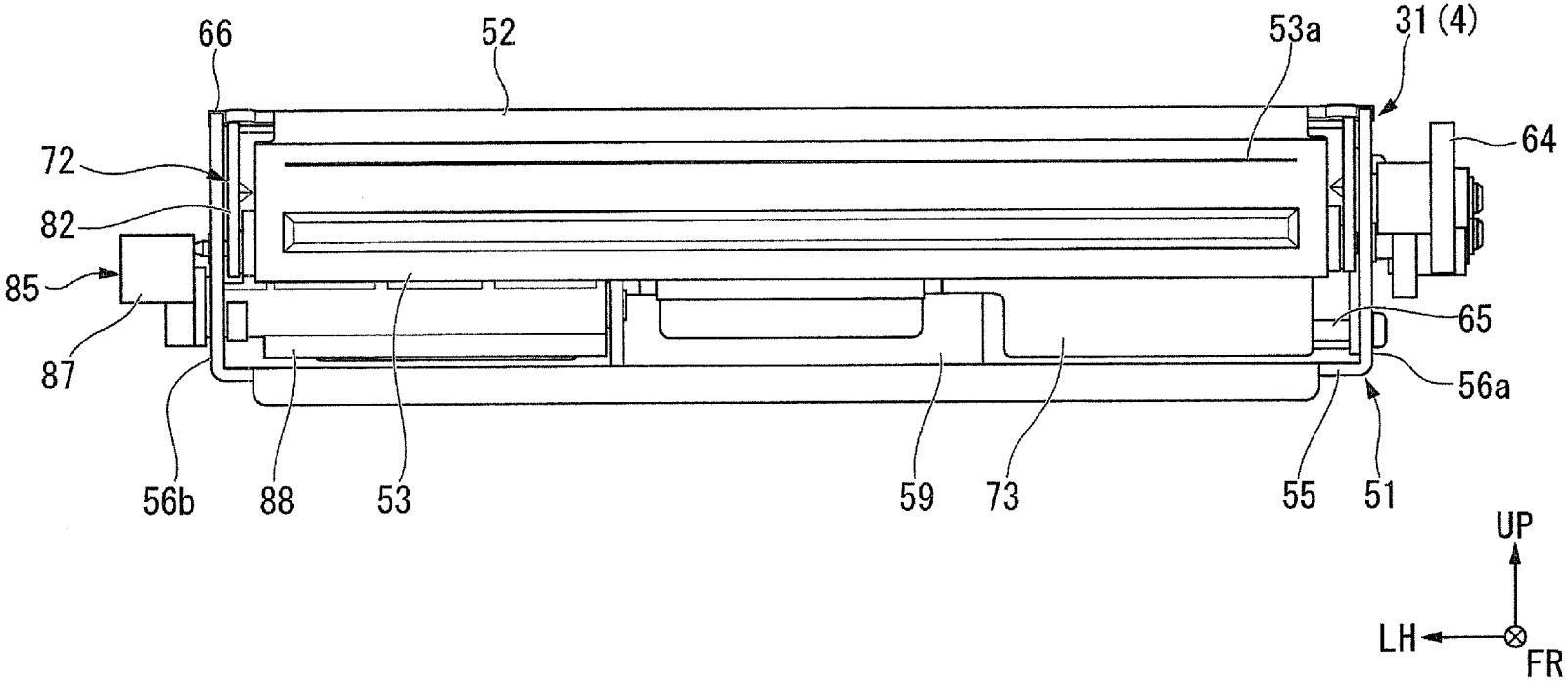
FIG. 5 is a rear view of the printing unit seen from back.

FIG. 5 is a rear view of the printing unit 4 seen from back. Note that, FIG. 5 is an illustration of a removed state in which the platen unit 32 is removed from the head unit 31. As illustrated in FIG. 3 to FIG. 5, the head unit 31 includes a main body frame 51 mounted to the casing 2, a head support body 52 supported by the main body frame 51, a thermal head 53 that is bonded and fixed to the head support body 52, and a lock mechanism 54 configured to removably hold the platen unit 32.

Figure 6:
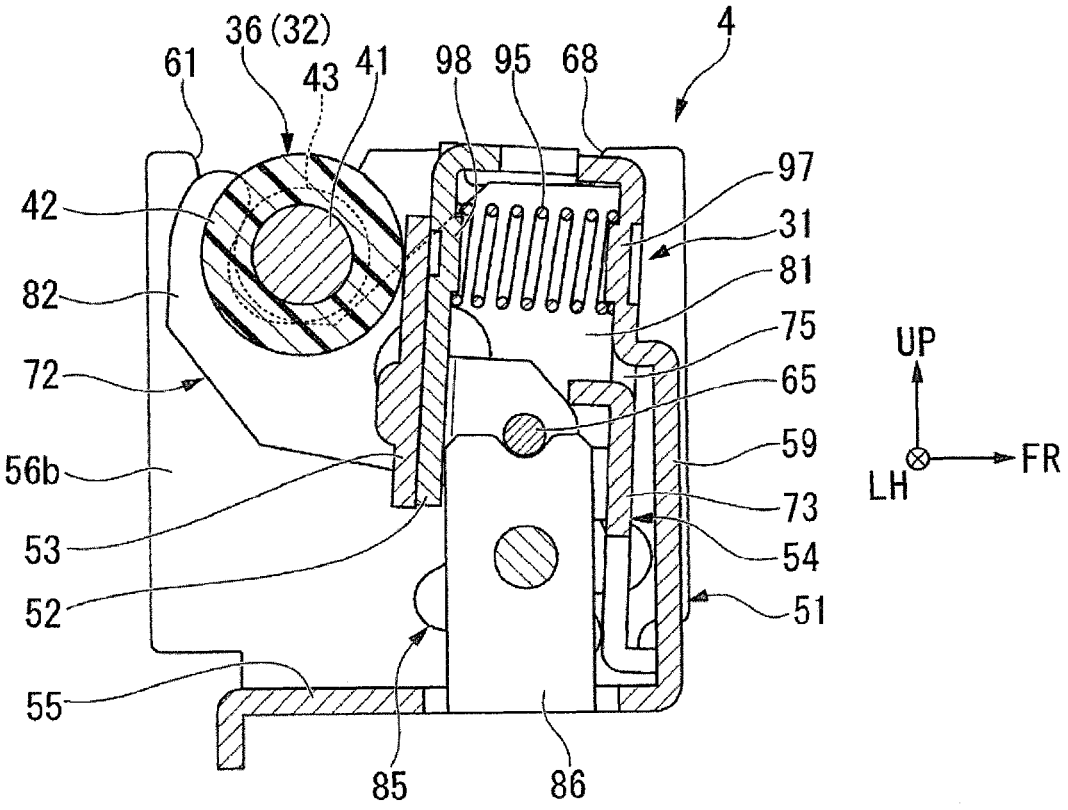
FIG. 6 is a sectional view taken along the line VI-VI of FIG. 4.
Figure 7:
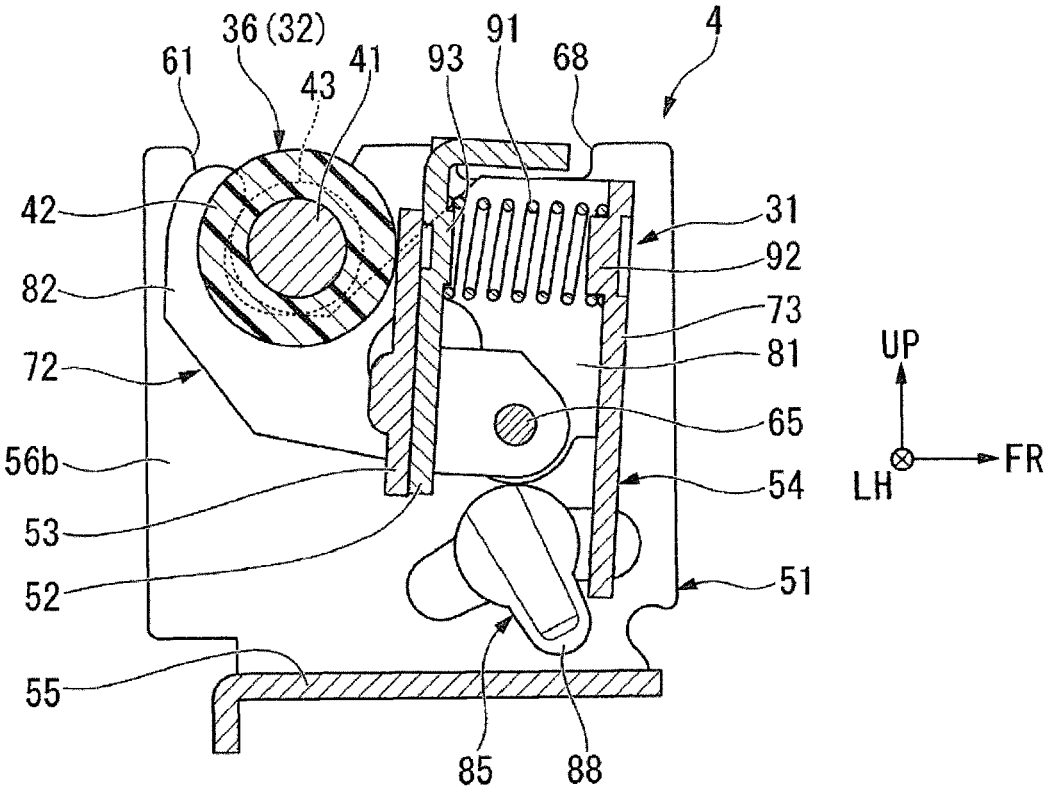
FIG. 7 is a sectional view taken along the line VII-VII of FIG. 4.

FIG. 6 is a sectional view taken along the line VI-VI of FIG. 4, and FIG. 7 is a sectional view taken along the line VII-VII of FIG. 4. As illustrated in FIG. 3 to FIG. 7, the main body frame 51 is formed by bending a plate material made of a metal or the like, and has a U-like shape that is open upward seen from front in a front-back direction. Specifically, the main body frame 51 mainly includes a bottom wall portion 55 extending along the horizontal direction, and a pair of side wall portions 56*a* and 56*b* formed in an upright state so as to extend upward from both end portions of the bottom wall portion 55 in the horizontal direction. The head unit 31 is arranged so that the thermal head 53 faces the inside of the roll sheet receiving portion 21 by fixing the bottom wall portion 55 onto a base member (not shown) arranged in the casing 2.

The bottom wall portion 55 has a width in the horizontal direction that is larger than a width of the recording sheet P. An extension wall 59 extending upward is formed so as to be connected to a center portion of the bottom wall portion 55 in the horizontal direction. The extension wall 59 has a height in a vertical direction that is equivalent to those of the side wall portions 56*a* and 56*b* of the main body frame 51.

A roller receiving portion 61 configured to receive the bearing 43 of the platen roller 36 described above when the paper cover 3 is located at the closed position is formed in an upper edge of each of the side wall portions 56*a* and 56*b*. The roller receiving portion 61 is open upward and has a width in the front-back direction that gradually reduces toward the bottom.

One (in the exemplary illustration, right) side wall portion 56*a* of the side wall portions 56*a* and 56*b* has a motor 62 mounted thereto. The motor 62 is mounted to the side wall portion 56*a* from a side nearer to a center portion in the horizontal direction, and an output shaft 62*a* thereof pierces the side wall portion 56*a* and protrudes from the main body frame 51 to a side farther from the center portion in the horizontal direction. A driving gear 63 is mounted to an end portion of the output shaft 62*a* of the motor 62 that protrudes from the side wall portion 56*a*. The driving gear 63 is engaged with the gear train mechanism 64 that is rotatably supported by the side wall portion 56*a*. The gear train mechanism 64 is engaged with the gear 45 for the platen of the platen roller 36 when the paper cover 3 is located at the closed position, and transfers rotational force of the motor 62 to the platen roller 36.

The head support body 52 is a plate-like member with a thickness direction thereof being the front-back direction and a longitudinal direction thereof being the horizontal direction, and is arranged at the back of the extension wall 59 between the side wall portions 56*a* and 56*b* of the main body frame 51. The head support body 52 is pivotably supported on a pivot shaft 65 at a lower end portion thereof. Both end portions of the pivot shaft 65 in an axial direction are individually fixed to the side wall portions 56*a* and 56*b* of the main body frame 51, respectively. This allows the head support body 52 to pivot on the pivot shaft 65 in the front-back direction. Stoppers 66 configured to limit the range of the pivot of the head support body 52 are formed at upper end portions of the head support body 52. The stoppers 66 are formed so as to protrude to sides farther from a center portion of the head support body 52 in the horizontal direction, and are received in stopper concave portions 68 formed in upper end portions of the side wall portions 56*a* and 56*b* of the main body frame 51, respectively. Each of the stoppers 66 can move in the corresponding stopper concave portion 68 in conjunction with a pivot of the head support body 52 to be brought into contact with both end surfaces of the corresponding stopper concave portion 68 in the front-back direction. Abutment of the stopper 66 against the both end surfaces of the stopper concave portion 68 restricts a further pivot of the head support body 52.

The thermal head 53 is configured to perform printing on a portion of the recording sheet P that is guided by the printing unit 4, and is bonded and fixed to a rear surface of the head support body 52. Specifically, the thermal head 53 is in the shape of a rectangle with a longitudinal direction thereof being the horizontal direction in plan view seen from the front-back direction, and is arranged so that a rear surface thereof faces the inside of the roll sheet receiving portion 21 in the casing 2. A large number of heating elements 53*a* are arranged on a head surface of the thermal head 53 along the horizontal direction. Note that, the head surface is a surface opposed to a printing surface of the recording sheet P, and the recording sheet P can be sandwiched between the head surface and an outer circumferential surface of the platen roller 36. Each of the heating elements 53*a* of the thermal head 53 is controlled to generate heat based on a signal from a control portion (not shown). Through control of heat generation by the heating elements 53*a*, various kinds of letters, shapes, and the like can be printed on the printing surface of the recording sheet P.

The lock mechanism 54 includes a pair of lock arms 72 configured to hold the bearings 43 of the platen roller 36, respectively, and a connecting plate 73 configured to connect the lock arms 72. The connecting plate 73 has a plate-like shape and extends along the horizontal direction with a thickness direction thereof being the front-back direction, and is arranged between the side wall portions 56*a* and 56*b* of the main body frame 51, and between the extension wall 59 and the head support body 52 in the front-back direction. A concave portion 75 that is recessed downward is formed at a center portion of the connecting plate 73 in the horizontal direction. A lower edge of the concave portion 75 is located lower than an upper edge of the extension wall 59. With this, an upper portion of the extension wall 59 is opposed to the head support body 52 described above in the front-back direction across the concave portion 75.

The lock arms 72 include arm portions 81 formed so as to protrude backward from both end portions of the connecting plate 73 in the horizontal direction, and hook portions 82 formed so as to extend backward from rear end portions of the arm portions 81, respectively. The arm portions 81 extend along the front-back direction in a clearance between the head support body 52 and the side wall portions 56*a* and 56*b*, respectively, in the horizontal direction, and are pivotably supported on the pivot shaft 65 described above. In this embodiment, the lock mechanism 54 pivots, similarly to the head support body 52, on the pivot shaft 65 between a lock position (see FIG. 6 and FIG. 7) at which the lock mechanism 54 holds the bearings 43 of the platen roller 36 and an unlock position (see FIG. 8 and FIG. 9) at which the bearings 43 of the platen roller 36 are removable from the roller receiving portions 61, respectively.

Each of the hook portions 82 has an L-like shape that is bent upward in side view seen from the horizontal direction, and enters the back of the roller receiving portion 61 through below the roller receiving portion 61. The hook portions 82 cradle the bearings 43 of the platen roller 36 from the back toward the front in the mounted state in which the platen unit 32 is mounted to the head unit 31 (lock position of the lock mechanism 54). In the mounted state, the hook portions 82 hold the bearings 43 of the platen roller 36 between inner circumferential edges thereof and inner circumferential edges of the roller receiving portions 61, and restrict removal of the bearings 43 of the platen roller 36 from the roller receiving portions 61.

A release lever 85 configured to release the mounted state between the platen unit 32 and the head unit 31 in conjunction with operation of the open button 18 is formed on the side of the left side wall portion 56*b* of the side wall portions 56*a* and 56*b* of the main body frame 51. The release lever 85 is formed so as to extend along the horizontal direction, and both end portions thereof are pivotably supported by the side wall portion 56*b* and a base 86 that is cut and raised from the bottom wall portion 55, respectively. A portion of the release lever 85 that is located outside the side wall portion 56*b* in the horizontal direction has a first operation piece 87 that is engaged with the open button 18 described above in the casing 2. On the other hand, a portion of the release lever 85 that is located inside the side wall portion 56*b* in the horizontal direction has a second operation piece 88 that is engaged with the head support body 52 of the lock mechanism 54. The release lever 85 pivots in conjunction with operation of pressing down the open button 18 (operation of opening the paper cover 3) to press the lock mechanism 54 toward the unlock position via the second operation piece 88.

Incidentally, first urging members 91 configured to urge the head support body 52 and the lock mechanism 54 away from each other are interposed therebetween. The first urging members 91 are each, for example, a coil spring, and one end portion thereof abuts the head support body 52 from front while another end portion thereof abuts, from back, portions of the connecting plate 73 of the lock mechanism 54 located on both sides of the concave portion 75 in the horizontal direction. This allows the first urging members 91 to urge the lock mechanism 54 toward the lock position and to urge the head support body 52 in such a direction that the thermal head 53 is brought closer to the outer circumferential surface of the platen roller 36. Note that, boss portions 92 and 93 that are inserted into the first urging members 91, respectively, and configured to restrict misalignment of the first urging members 91 with respect to the connecting plate 73 and the head support body 52 are formed on portions of the connecting plate 73 of the lock mechanism 54 and the head support body 52 that abut the first urging members 91.

Second urging members (head pressing members) 95 configured to urge the head support body 52 and the extension wall 59 of the main body frame 51 away from each other are interposed therebetween. The second urging members 95 are each, for example, a coil spring, and one end portion thereof abuts the head support body 52 from front while another end portion thereof abuts the extension wall 59 from back through the concave portion 75 of the connecting plate 73. This allows the second urging members 95 to urge the head support body 52 in the approaching direction. Note that, boss portions 97 and 98 that are inserted into the second urging members 95, respectively, and configured to restrict misalignment of the second urging members 95 with respect to the head support body 52 and the extension wall 59 are formed on portions of the head support body 52 and the extension wall 59 that abut the second urging members 95.

As described above, of the urging members 91 and 95, the first urging members 91 in a pair are arranged on both sides in the horizontal direction, and the second urging members 95 in a pair are arranged between the first urging members 91. Specifically, the first urging members 91 are arranged nearer to the lock arm 72 than the second urging members 95. Further, in this embodiment, the first urging members 91 have both the function of platen holding and the function of head pressurization, while the second urging members 95 have only the function of head pressurization. Therefore, urging force for the head pressurization (total urging force of the first urging members 91 and the second urging members 95) is larger than urging force for the platen holding (total urging force of the first urging members 91).

Note that, design change of the urging force of the first urging members 91 and the urging force of the second urging members 95 can be made as appropriate. In this case, it is preferred that the urging force of the first urging members 91 be set so that urging force necessary for the platen holding can be secured. Further, it is preferred that the urging force of the second urging members 95 be set so that difference between urging force necessary for the head pressurization and the urging force of the first urging members 91 can be compensated for.

Next, action of the thermal printer 1 described above is described. First, operation of closing the paper cover 3 is described. As illustrated in FIG. 1 and FIG. 2, after the roll sheet R is fed in the roll sheet receiving portion 21, the paper cover 3 is closed. Then, first, the bearings 43 of the platen roller 36 are brought into contact with the hook portions 82 of the lock arms 72, respectively, and an outer circumferential surface of the roller main body 42 is brought into contact with the thermal head 53.

Figure 8:
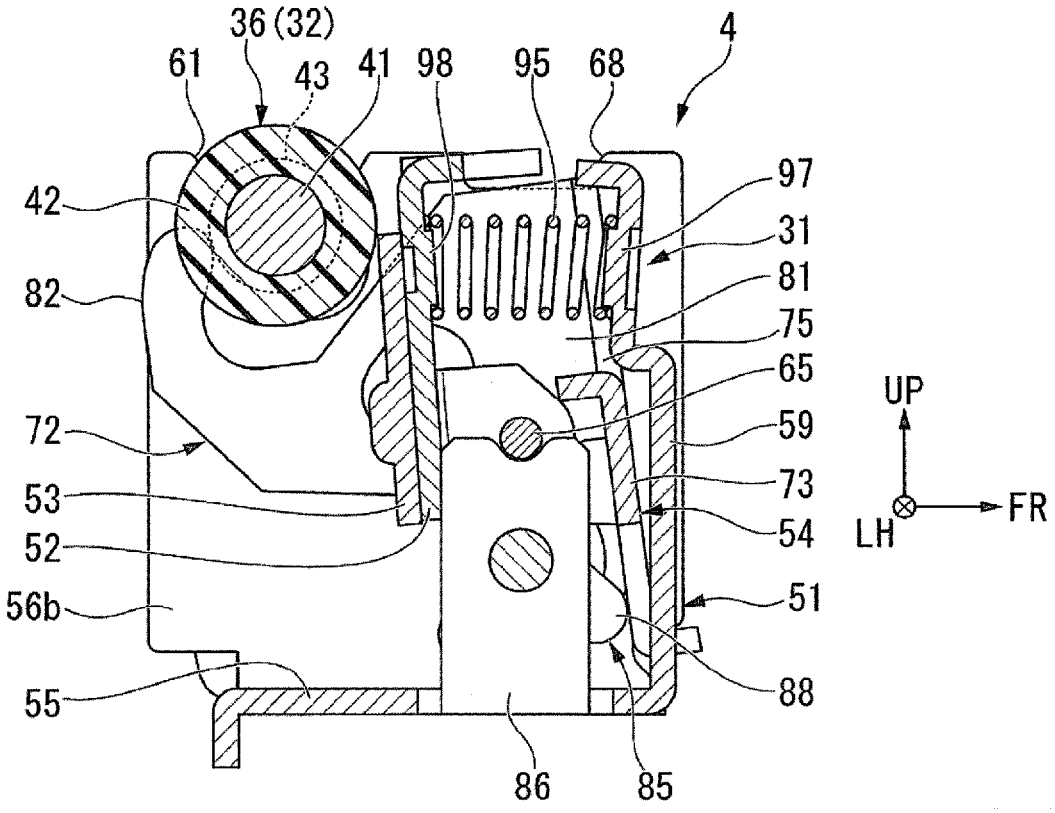
FIG. 8 is an explanatory view for illustrating operation of opening and closing the paper cover, and is a sectional view taken along the line VI-VI of FIG. 4.
Figure 9:
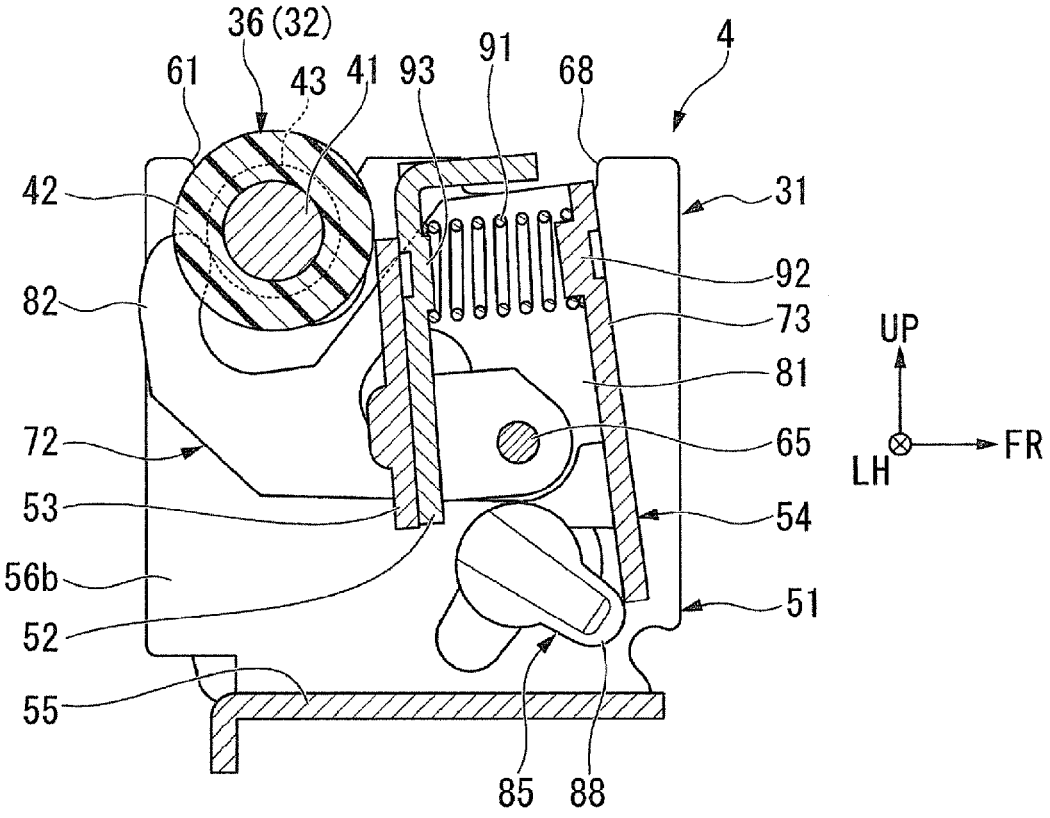
FIG. 9 is an explanatory view for illustrating operation of opening and closing the paper cover, and is a sectional view taken along the line VII-VII of FIG. 4.

FIG. 8 and FIG. 9 are explanatory views for illustrating the operation of opening and closing the paper cover 3. FIG. 8 is a sectional view taken along the line VI-VI of FIG. 4, and FIG. 9 is a sectional view taken along the line VII-VII of FIG. 4. As illustrated in FIG. 8 and FIG. 9, when the paper cover 3 is further pressed in toward the closing direction, the bearings 43 of the platen roller 36 press the lock mechanism 54 via the hook portions 82, and pivot the lock mechanism 54 toward the unlock position (direction against the urging force of the first urging members 91). When the outer circumferential surface of the roller main body 42 presses the head support body 52 via the thermal head 53, the platen roller 36 pivots the head support body 52 on the pivot shaft 65 toward the direction against the urging force of the first urging members 91 and the second urging members 95. This widens a clearance between the hook portions 82 and the thermal head 53 in the front-back direction and allows entrance of the bearings 43 into the roller receiving portions 61 of the main body frame 51, respectively.

After that, as illustrated in FIG. 6 and FIG. 7, at a point in time at which the bearings 43 climb over tops of the hook portions 82, respectively, the lock mechanism 54 pivots toward the lock position by resilience of the first urging members 91. This brings the mounted state in which the bearings 43 are held between the inner circumferential edges of the hook portions 82 and the inner circumferential edges of the roller receiving portions 61 and the platen unit 32 is combined with the head unit 31, and the paper cover 3 is located at the closed position. Note that, in the mounted state, the gear 45 for the platen of the platen unit 32 is engaged with the gear train mechanism 64 of the head unit 31. In this way, the operation of closing the paper cover 3 is completed.

When the paper cover 3 is located at the closed position, the lock mechanism 54 is urged toward the lock position by the urging force of the first urging members 91, and thus, predetermined platen holding force acts on the bearings 43 of the platen roller 36. On the other hand, the head support body 52 is urged toward the approaching direction by the urging force of both the first urging members 91 and the second urging members 95, and thus, predetermined head pressurizing force acts between the roller main body 42 and the thermal head 53.

When the thermal printer 1 is actuated in this state, the rotational force of the motor 62 is transferred to the platen roller 36 via the gear train mechanism 64 to rotate the platen roller 36. This enables feeding of the recording sheet P sandwiched between the platen roller 36 and the thermal head 53. Further, through heat generation by the heating elements 53*a* of the thermal head 53 as appropriate in conjunction with the feeding, various kinds of letters, shapes, and the like can be clearly printed on the recording sheet P that is fed. After that, through pulling of the recording sheet P discharged from the discharge port 24 against the cutting blade 25, the recording sheet P is cut. As a result, the recording sheet P wound into the roll sheet R can be used as a receipt or the like.

Next, the operation of opening the paper cover 3 is described. First, the open button 18 is pressed down, and the release lever 85 pivots in conjunction therewith. As illustrated in FIG. 8 and FIG. 9, the lock mechanism 54 is pressed via the second operation piece 88 to pivot the lock mechanism 54 toward the unlock position (direction against the urging force of the first urging members 91). This retreats the hook portions 82 of the lock mechanism 54 to the unlock position at which the bearings 43 are removable from the roller receiving portions 61. When the paper cover 3 is pulled up in this state, the bearings 43 of the platen roller 36 are removed from the roller receiving portions 61. This brings the removed state in which the platen unit 32 is removed from the head unit 31, and the paper cover 3 is located at the opened position. Note that, the platen roller 36 may be pushed up toward a direction in which the bearings 43 are removed from the roller receiving portions 61 by the urging force of the second urging members 95 via the thermal head 53 when the lock mechanism 54 is located at the unlock position. In this way, the operation of opening the paper cover 3 is completed.

As described above, according to this embodiment, the printing unit 4 includes the first urging members 91 configured to urge the lock mechanism 54 toward the lock position and configured to urge the head support body 52 toward the approaching direction, and the second urging members 95 configured to urge the head support body 52 toward the approaching direction. According to this configuration, through urging of the lock mechanism 54 toward the lock position by the urging force of the first urging members 91, the predetermined platen holding force acts on the bearings 43 of the platen roller 36. On the other hand, through urging of the head support body 52 toward the approaching direction by the urging force of both the first urging members 91 and the second urging members 95, the predetermined head pressurizing force acts between the roller main body 42 and the thermal head 53. This enables platen holding force to be reduced compared with a case in which both the platen holding and the head pressurization are carried out by the same urging member, and still, desired head pressurizing force to be secured. As a result, operability of the lock mechanism 54 can be improved and print quality can be secured. Further, head pressurizing force is secured by both the first urging members 91 and the second urging members 95, and thus, compared with a case in which the platen holding and the head pressurization are separately carried out by different urging members, the number of components can be reduced and costs can be reduced.

In addition, the second urging members 95 urge only the head support body 52, and thus, by changing the number, the kind, and the like of the second urging members 95, only the head pressurizing force can be independently adjusted under a state in which the platen holding force is maintained, and desired head pressurizing force depending on a sheet width can be secured. Further, as described above, the platen holding force can be reduced, and thus, the lock mechanism 54 can be thinned and the degree of design freedom can be improved.

Further, in this embodiment, the second urging members 95 are formed of coil springs, and thus, simplification and lower costs are attained, and still, the desired head pressurizing force can be secured. Further, the first urging members 91 are arranged outside the second urging members 95 in the horizontal direction, and thus, the first urging members 91 and the lock arms 72 can be brought closer to each other, and operational stability of the lock mechanism 54 can be secured.

Further, the second urging members 95 are interposed between the main body frame 51 and the head support body 52, and thus, the head unit 31 can be assembled to the casing 2 with the second urging members 95 being assembled thereto. This can improve ease of assembly when the head unit 31 is assembled to the casing 2 compared with a configuration in which the second urging members 95 are interposed between the casing 2 and the head support body 52.

Still further, the thermal printer 1 according to this embodiment includes the printing unit 4 described above, and thus, the thermal printer 1 excellent in print quality and operability can be provided.

Note that, the technical scope of the present invention is not limited to the above-mentioned embodiment, but various modifications can be made without departing from the gist of the present invention.

For example, in the embodiment described above, a configuration in which the first urging members 91 and the second urging members 95 are separate from the lock mechanism 54 and the head support body 52 is described, but the first urging members 91 and the second urging members 95 may be formed integrally with the lock mechanism 54 and the head support body 52. Further, a case in which coil springs are used as the first urging members 91 and the second urging members 95 is described, but the present invention is not limited thereto, and various kinds of urging members can be used. In this case, through use of, for example, leaf springs, the printing unit 4 can be thinned in the front-back direction.

Further, in the embodiment described above, a case in which the second urging members 95 (coil springs) are used as the head pressing member is described, but the present invention is not limited thereto, and design change can be made as appropriate insofar as the head support body 52 is pressed toward the approaching direction. In this case, for example, an actuator such as a linear actuator or a solenoid may be adopted. Further, in the embodiment described above, a configuration in which the second urging members 95 are interposed between the head support body 52 and the main body frame 51 is described, but the present invention is not limited thereto, and the second urging members 95 may be interposed between the casing 2 and the head support body 52. Specifically, it is sufficient that the second urging members 95 press the head support body 52 toward the approaching direction.

Still further, in the embodiment described above, a configuration in which the roller receiving portions 61 are open upward is described, but the present invention is not limited thereto. For example, a direction of openings of the roller receiving portions 61 may be slanted forward (to the thermal head 53 side) with respect to the vertical direction. This releases the roller receiving portions 61 in a direction opposite to the pivotal direction of the paper cover 3 in the mounted state described above, and thus, falling off of the platen roller 36 from the roller receiving portions 61 can be inhibited. Further, the direction of openings of the roller receiving portions 61 may be slanted backward (to a side opposite to the thermal head 53 side) with respect to the vertical direction. This releases the roller receiving portions 61 in the same direction as the pivotal direction of the paper cover 3 in the mounted state described above, and thus, operability of the operation of opening and closing the paper cover 3 can be further improved.

Besides the above, the components in the above-mentioned embodiment may be replaced by well-known components as appropriate without departing from the gist of the present invention. The above-mentioned modified examples may be combined with each other as appropriate.

What is claimed is:

1. A printing unit comprising:

a main body frame;

a platen roller removably mounted to the main body frame;

a lock mechanism pivotably supported by the main body frame between a lock position at which the platen roller is rotatably held by the main body frame and an unlock position at which the platen roller is removable from the main body frame;

a thermal head configured to be brought into pressure contact with an outer circumferential surface of the platen roller;

a head support body configured to support the thermal head, the head support body being pivotably supported by the main body frame in such directions that the thermal head and the platen roller are brought closer to and away from each other;

an urging member interposed between the lock mechanism and the head support body, the urging member being configured to urge the lock mechanism toward the lock position and urge the head support body in such a direction that the thermal head is brought closer to the platen roller; and a head pressing member configured to press the head support body in such a direction that the thermal head is brought closer to the platen roller, the head pressing member and the urging member aligned with each other along an axis parallel to an axis of the platen roller.

2. A printing unit according to claim 1, wherein the head pressing member is a spring configured to urge the head support body in a direction such that the thermal head is brought closer to the platen roller.

3. A printing unit according to claim 2, wherein the lock mechanism individually holds axial end portions of the platen roller, and the urging member is away from the head pressing member in an axial direction of the platen roller.

4. A printing unit according to claim 1, wherein the head pressing member is between the main body frame and the head support body.

5. A printer including the printing unit according to claim 1.

* * * * *